US006832797B1

(12) United States Patent
Gassel et al.

(10) Patent No.: US 6,832,797 B1
(45) Date of Patent: Dec. 21, 2004

(54) CAULK TUBE CARRIER

(76) Inventors: David F. Gassel, 6870 Howdershell, Hazelwood, MO (US) 63042; Roger L. Gassel, 3 Rendina Ct., Ellisville, MO (US) 63011

( * ) Notice: Subject to any disclaimer, the term of this patent is extended or adjusted under 35 U.S.C. 154(b) by 187 days.

(21) Appl. No.: 10/273,190

(22) Filed: Oct. 17, 2002

(51) Int. Cl.[7] ..... A45F 5/00; A47F 7/00

(52) U.S. Cl. ..... 294/143; 294/145; 294/159; 211/70.6

(58) Field of Search ..... 294/143, 145, 294/148, 159, 162, 163, 166; 211/60.1, 70.6; 206/372, 384

(56) References Cited

U.S. PATENT DOCUMENTS

| | | | | | |
|---|---|---|---|---|---|
| 1,675,543 | A | | 7/1928 | Fremon et al. | 211/69.7 |
| 3,724,676 | A | | 4/1973 | Anderka | 211/69.7 |
| 4,090,612 | A | | 5/1978 | Lostutter | 211/13 |
| 4,326,648 | A | | 4/1982 | Kieber | 222/162 |
| 4,830,247 | A | * | 5/1989 | Banks | 224/666 |
| 5,080,240 | A | | 1/1992 | Williams | 211/70.6 |
| 5,378,433 | A | * | 1/1995 | Duckett et al. | 422/100 |
| 5,609,283 | A | | 3/1997 | Harrison, Jr. | 224/678 |
| 5,788,194 | A | | 8/1998 | Van Den Berg | 248/109 |
| 5,871,106 | A | | 2/1999 | Oksa et al. | 211/70.6 |
| 6,102,215 | A | | 8/2000 | Guida | 211/70.6 |
| 6,193,081 | B1 | | 2/2001 | Ewing | 211/70.6 |

* cited by examiner

*Primary Examiner*—Dean J. Kramer
(74) *Attorney, Agent, or Firm*—Grace J. Fishel

(57) ABSTRACT

A carrier for storing a plurality of caulk tubes in a manner that they are easily identifiable and, if open, so that the contents do not dry out. The carrier has a frame within which the caulk tubes are resiliently biased between a socket for receipt of a nozzle of the caulk tube and a holder attached to an end of the caulk tube opposite the nozzle.

12 Claims, 3 Drawing Sheets

CAULK TUBE CARRIER

BACKGROUND OF THE INVENTION

1. Field of the Invention

The present invention relates to a carrier for storing a plurality of caulk tubes such that they are easily identifiable and, if opened, so that the contents do not dry out.

2. Brief Description of the Prior Art

Caulks, adhesives and other compounds (hereinafter referred to collectively as "caulk") are widely used in the construction and painting professions. Caulk is typically sold in disposable cartridges or tubes with a nozzle at one end and a piston at the opposite end. The contents of the tube are extruded through the nozzle with a caulking gun that forcibly drives the piston into the tube with a plunger.

There are many different kinds of caulk, each designed for a specific application. For example, there are silicone, butyl rubber and acrylic sealants, provided in different colors, adhesives of many types and so forth. For this reason, it is not uncommon for a workman, whether professional or amateur, to have a number of different tubes of caulk on hand for use as needed.

Most caulks solidify in the presence of air. To preserve the contents of a caulk tube prior to use, manufacturers place a metal foil seal at the base of the nozzle, which seal is punctured prior to use. Once the nozzle is cut and the foil broken, air is in contact with the material at the nozzle opening. If left open, the material will solidify in the nozzle and clog the opening. Because the manufacturer provides no means for re-closing the tip, most users put a nail or screw in the tip as a stopgap plug. Because the nail or screw is usually the wrong diameter, caulk tends to ooze around the plug until a solid mass of dried caulk is formed in the gap between the nail or screw and the nozzle orifice. This mass of material must be dug out when the nail or screw is removed so that the still-viscous material in the tube can flow smoothly out the nozzle. Removal of the solid material in the tip is very difficult or impossible due to the small size of the nozzle opening.

Caulk tubes are cylindrical in shape with the contents of the tube identified with a label on the side of the tube. After they are opened, they are preferably stored nozzle end up to prevent the contents from flowing out of the nozzle. Caulk tubes are easily knocked over and have a tendency to roll on a horizontal surface. When the caulk tubes are stored in a box or a bucket, it is difficult to determine the contents of a particular tube without withdrawing it from the container and examining the label.

BRIEF SUMMARY OF THE INVENTION

In view of the above, it is an object of the present invention to provide a carrier for conveniently storing new or opened caulk tubes so that they are displayed for ease of selection among several tubes containing different materials. It is another object to provide a carrier with means for quickly and easily plugging the nozzle of an open tube as the tube is inserted into the carrier. Other objects and features of the invention will be in part apparent and in part pointed out hereinafter.

In accordance with the invention, a carrier is provided for holding at least one caulk tube of the kind found in an ordinary hardware store. Such tubes have a cylindrical hollow body for containing a viscous material, a piston slidably disposed within a bore of the hollow body adapted to seal the viscous material within the body. A cavity is provided between the piston and a first end of the body for receipt of a plunger of a caulking gun. A cap is provided at a second end of the hollow body with a tapered nozzle extending from the cap through which the viscous material is extruded when the piston is forced into the bore by the plunger.

The carrier includes a frame with a base, a top and first and second sides for interconnecting the base and the top. A first holder is provided for attaching to a first end of a caulk tube and a second holder is attached to the base of the frame. A resilient biasing member interconnects the first and second holders and a socket is attached to the top of the frame. The socket is adapted to grip a nozzle of a caulk tube and form a seal. The socket and the second holder are spaced apart in opposition. In use, the resilient biasing member biases a caulk tube held in said carrier between the socket and said first holder.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
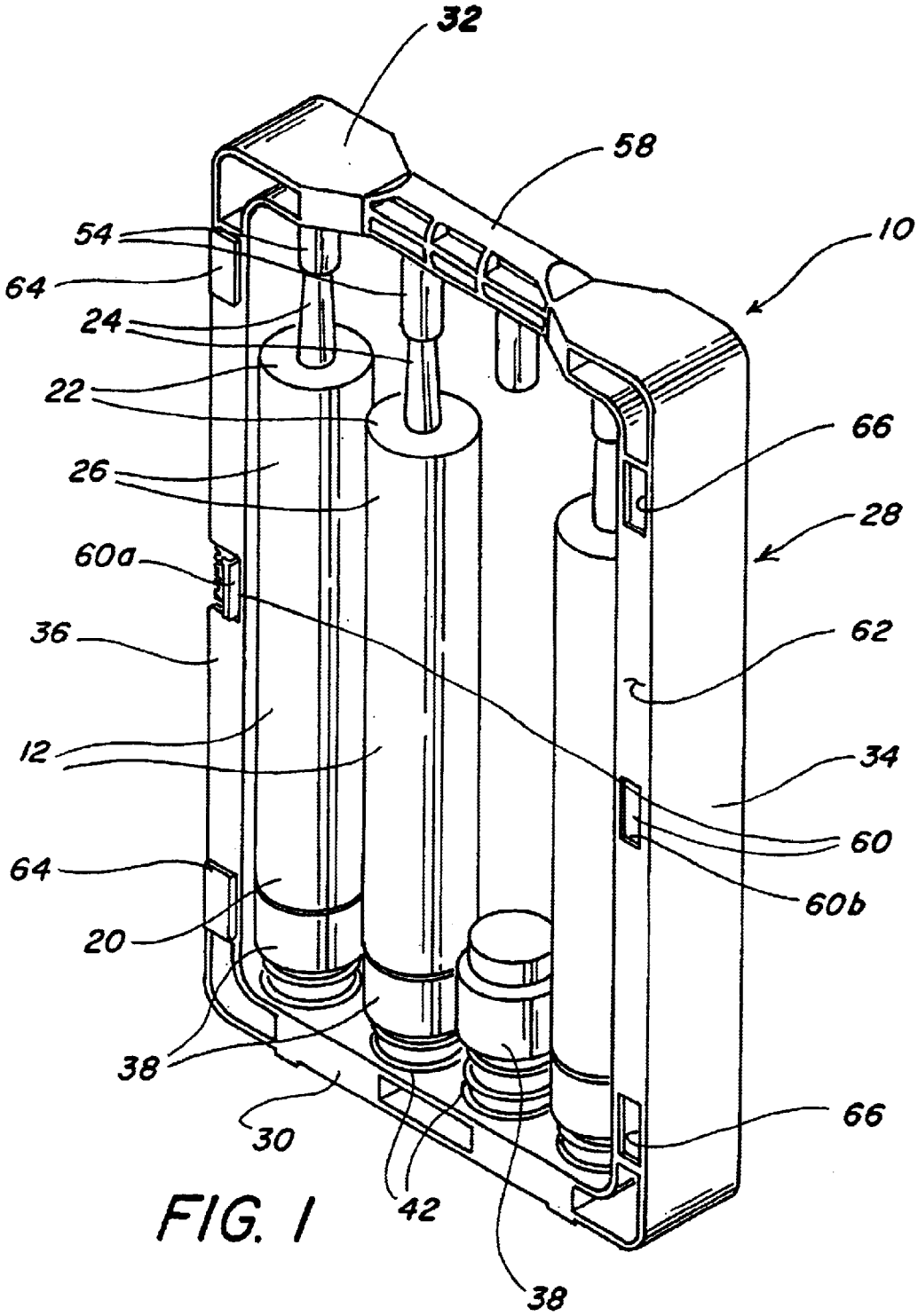
FIG. 1 is a perspective view of a caulk tube carrier in accordance with the present invention.
Figure 2:
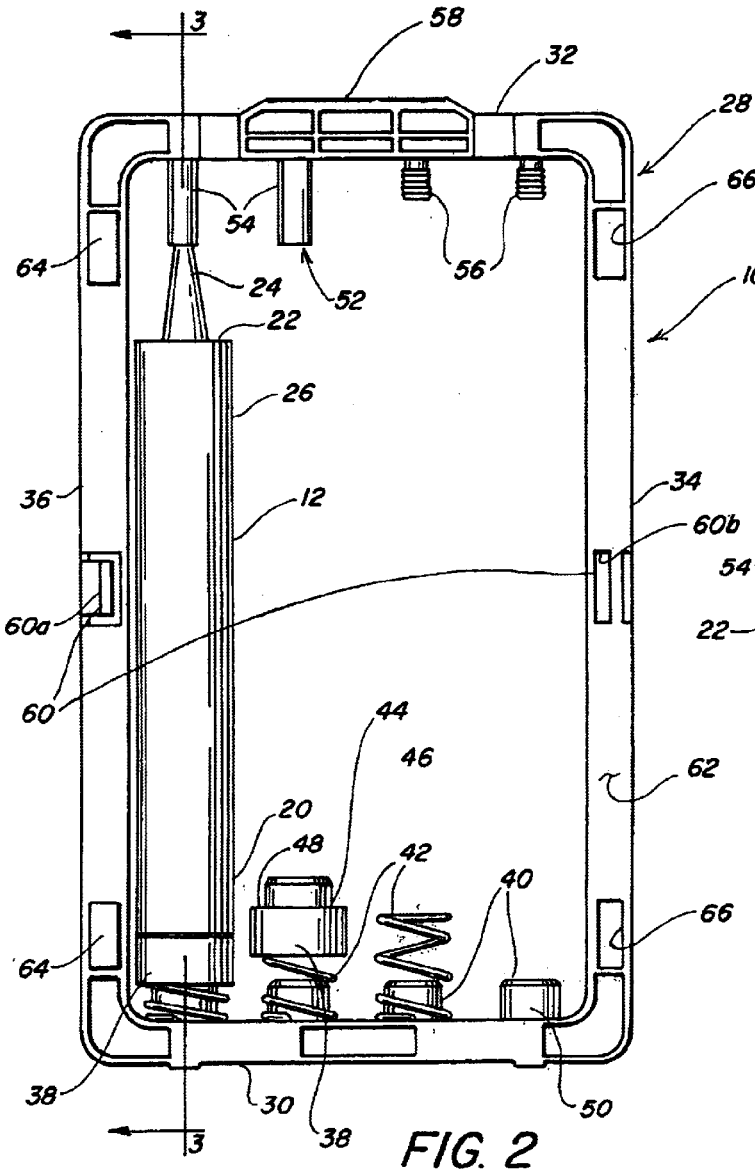
FIG. 2 is a front elevation of the carrier.
Figure 3:
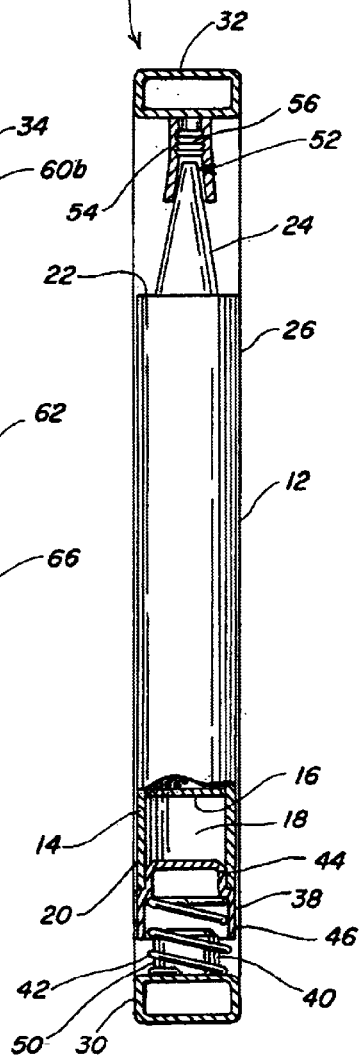
FIG. 3 is a section taken along line 3—3 in FIG. 2, partially broken away to show details of a first and second holder.
Figure 4:
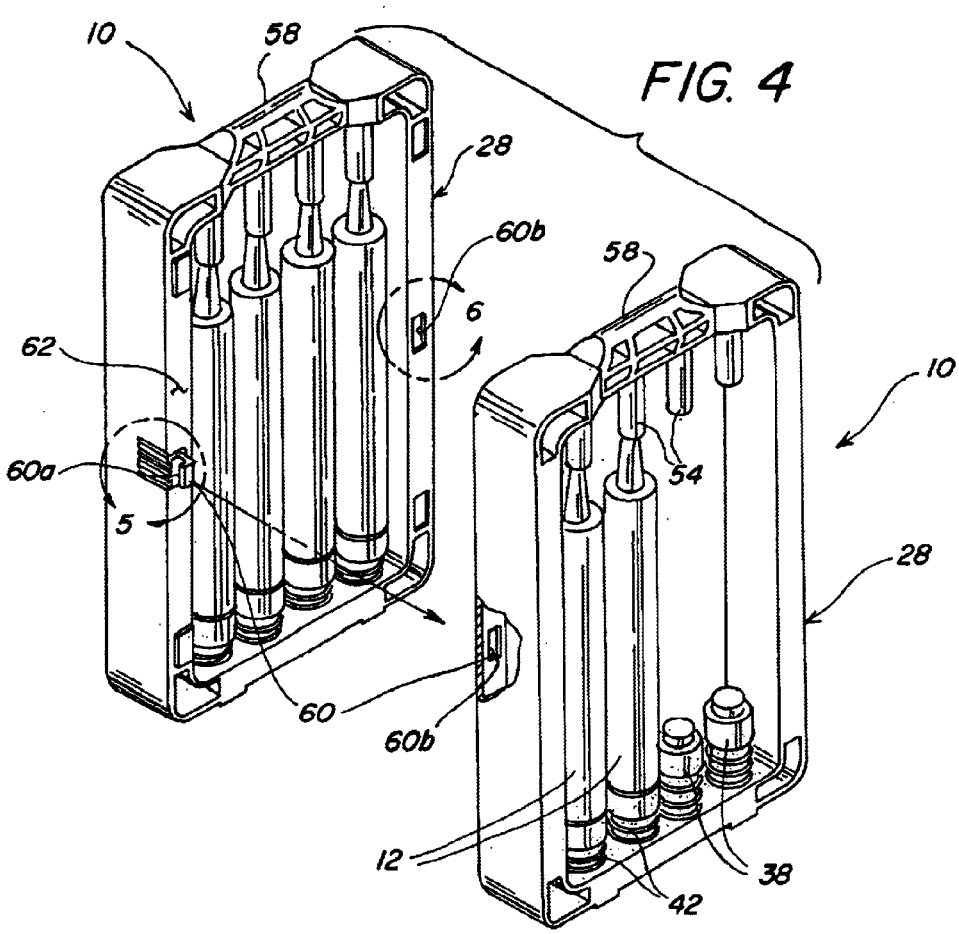
FIG. 4 is a perspective view of a pair of caulk tube carriers illustrating a means for linking them together.
Figure 5:
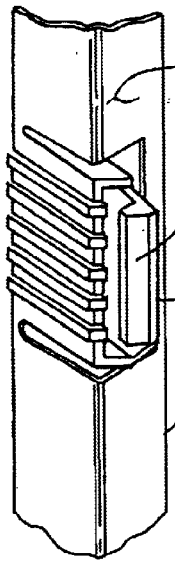
FIG. 5 is a detail taken along line 5—5 in FIG. 4 showing a latching finger; and, FIG. 6 is a detail taken along line 6—6 in FIG. 4 showing a receiving slot for a latching finger.
Figure 6:
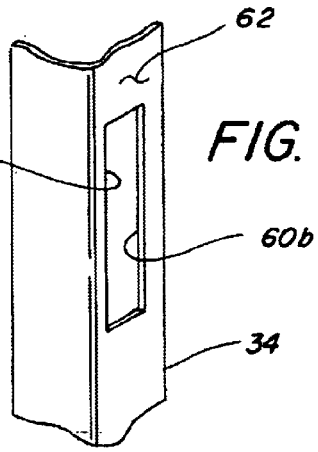

Referring to the drawings more particularly by reference number, reference numeral 10 refers to a caulk tube carrier in accordance with the present invention. Carrier 10 is adapted for use in organizing caulk tubes 12 and in sealing open ones thereof.

Caulk tubes 12 for use with carrier 10 have a cylindrical hollow body 14 for containing a viscous material. A piston 16 is slidably disposed within a bore of hollow body 14 and a cavity 18 is formed between piston 16 and a first end 20 of hollow body 14. Cavity 18 receives a plunger of a standard caulking gun (not shown). A cap 22 with a tapered nozzle 24 is a provided at a second end 26 of hollow body 14. Nozzle 24 extends from cap 22 through which the viscous material is extruded when piston 16 is forced into the bore of hollow body 14 by the plunger of the caulking gun.

Ordinary caulk tubes 12 such as found in hardware stores are designed to be disposable and are about 2 inches in diameter and about 9 inches long not counting nozzle 24. Cylindrical hollow body 14 is formed from cardboard, plastic or the like and can be dented by rough handling.

Protection of caulk tubes 12 is important because if hollow body 14 dented or otherwise damaged, piston 16 may not slide down the bore rendering the caulk tube useless.

Nozzle 24 is formed of a semi-rigid plastic which can be cut with a saw or knife. Nozzle 24 is tapered and usually round in cross-section so that a user can pick the size and shape of the orifice desired by cutting the nozzle at an appropriate point and angle. Although, round, tapered nozzles are nearly universal, it will be understood that the present invention can be used with nozzles 24 of other shapes.

Carrier 10 includes a frame 28 with a base 30, a top 32 and first and second sides 34, 36, respectively, for interconnecting base 30 and top 32. Carrier 10 is designed to hold at least one and preferably a plurality of caulk tubes 12 in frame 28. To this end, a first holder 38 is provided for attachment to first end 20 of caulk tube 12 and a second holder 40 is attached to base 30 of frame 28. A resilient biasing member 42 interconnects first and second holders 38, 40. As shown in the drawings, first holder 38 is a cylindrical plug with first and second sidewalls 44, 46, respectively of stepped diameter. Sidewalls 44 at a forward end of first holder have an outside diameter slightly less than the inside diameter of the bore of hollow body 14 such that they are received in cavity 18. First sidewalls 44 are connected to second sidewalls 46 by an annulus forming an abutment shoulder 48 for use as described below. Second sidewalls 46 may have an outside diameter approximately equal to the outside diameter of cylindrical body 14. While first holder 38 is illustrated as described above, it will be appreciated that other equivalent structures may serve as the first holder. For example, first holder 38 may be formed as a cap with first sidewalls 44 having an inside diameter slightly more than the outside diameter of cylindrical body 14 such that they are received over first end 20. In this case second sidewalls 46 may have the same outside diameter as first sidewalls 44 and abutment shoulder 48 may be an annulus or a disk dividing sidewalls 44, 46 into upper and lower compartments.

With continuing reference to the drawings, second holder 40 is shown as a cylindrical boss 50 which is formed on base 30 and resilient biasing member 42 is a coil spring. The inside diameter of resilient biasing member 42 is slightly less than the outside diameter of cylindrical boss 50 such that it is not easily dislodged and the outside diameter of resilient biasing member 42 is slightly more than the inside diameter of second sidewall 46 of first holder 38 such that it is not easily dislodged from it either. While second holder 40 and resilient biasing member 42 are illustrated as described above, it will be readily apparent that other equivalent structures may serve. For example, second holder 40 may be a recess formed in base 30. In this instance, the inside diameter of the recess should be slightly less than the outside diameter of resilient biasing member 42. Resilient biasing member 42 can take other forms also, the sole limitation being that it must serve as a spring in compression. For example resilient biasing member 42 may be a resilient pad formed of a compressible natural or synthetic material, an accordion or leaf spring, etc.

A socket 52 is attached to top 32 of frame 28. Socket 52 and first holder 38 oppose each other and are spaced apart a distance such that when the forward end of first holder 38 is attached to first end 20 of cylindrical body 14 of caulk tube 12 and nozzle 24 is received in socket 52, resilient biasing member 42 spring biases nozzle 24 into socket 52 with a constant force or predetermined "spring load" that creates a seal between nozzle 24 and socket 52. As shown in the drawings, socket 52 is a length of elastomeric tubing 54. A barbed post 56 is provided on top 32 over which tubing 54 is interference fitted. Tubing 54 extends beyond a free end of post 56 forming socket 52. For use in forming a seal, preferably an air-tight seal, tubing 54 has an inside diameter slightly less than the outside diameter of tapered nozzle 24. When socket 52 is elastomeric tubing 54, the constant force or "spring load" of resilient biasing member 42 causes elastomeric tubing 54 to swell tightly around nozzle 24 creating a substantially air tight seal no matter where the tip was cut open for usage. In other embodiments, a recess may be substituted for post 56 and tubing may be interference fitted into the recess. As with the other elements of carrier 10, socket 52 may take other equivalent forms. For example, socket 52 may be molded as an integral part of top 32 and may include a conical recess for sealing fit with nozzle 24. The post 56 and tubing 54 construction described above, however, is preferred because the tubing can be easily replaced if it becomes filled with dried caulk that oozed from an open caulk tube 12.

In a preferred embodiment, carrier 10 is designed to hold a plurality of caulk tubes 12. To this end, a plurality of assemblies including first and second holders 38, 40 and resilient biasing member 42 are provided on base 30, individual assemblies of which are aligned with a matching number of sockets 52 on top 32. As illustrated in the drawings, four caulk tubes 12 may be secured in carrier 10 at a time. Naturally, depending on the size of carrier 10, more or less caulk tubes may be accommodated.

A handhold 58 may be formed in top 32 of frame 28 such that carrier 10 may be easily transported. Linking members 60 may be provided on frame 28 for connecting two holders together to increase the storage capacity for caulk tubes 12. As shown in the drawings, linking members include a latching finger **60*a* and a receiving slot 60*b* which may be formed on a face 62 of the frame along first and second sides 34, 36. Latching finger 60*a* and receiving slot 60*b* are positioned such that when similar carrier units are positioned face to face, the latching finger of each unit is received in the corresponding receiving slot of the other. When latching finger 60*a* extends above face 62, as shown in the drawings, a plurality of leveling feet 64 may be provided on face 62 such that when only one carrier 10 is used, frame 28 will lie flat on a horizontal surface. Corresponding recesses 66 are provided in face 62 for receipt of leveling feet 64 of a second similar carrier 10 when two units are linked face to face. It will be appreciated that latching fingers 60*a* and receiving slots 60*b* may be provided on both sides of frame 28**, but for simplicity of molding the embodiment shown in the drawings represents the best mode presently known for practicing the invention.

As illustrated in the drawings, base 30, top 32 and sides 34, 36 form a band having a width slightly greater than the diameter of caulk tubes 12. This allows pairs of carriers 10 to be linked as described above and reduces the chance that caulk tubes 12 will be dented or otherwise damaged.

In use, carrier 10 may be used for storing a predetermined number of caulk tubes 12. A selected caulk tube 12 is installed in carrier 10 by attaching first holder 38 to first end 20 of caulk tube 12. With resilient biasing member 42 compressed slightly, the tapered end of nozzle 24 is fitted into socket 52. Upon release, resilient biasing member 42 spring biases the caulk tube between socket 52 and first holder 38 with a constant force or "spring load" in a manner that the caulk tube is held in frame 28 and prevented from substantial lateral movement relative thereto. The constant force or "spring load" of resilient biasing member 42 causes the orifice of open caulk tubes 12 to be sealed by socket 52.

The labels on caulk tubes 12 are displayed so that a user may easily make a selection among several tubes which may contain different materials. When base 30, top 32 and sides 34, 36 form a band having a width slightly greater than the diameter of caulk tubes 12, caulk tubes 12 may be safely stored or transported from workplace to workplace without significant risk that the tubes will be dented or otherwise damaged and rendered useless.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A carrier for holding at least one caulk tube of the type having a cylindrical hollow body for containing a viscous material, a piston slidably disposed within a bore of said hollow body and adapted to seal said viscous material within said body, a cavity formed between the piston and a first end of the body for receipt of a plunger of a caulking gun, a cap at a second end of said hollow body, and a tapered nozzle extending from said cap through which said viscous material is extruded when said piston is forced into said bore by the plunger, said carrier comprising:

a frame with a base, a top and first and second sides for interconnecting the base and the top, a first holder for attaching to a first end of a caulk tube, a second holder attached to the base of the frame, a resilient biasing member interconnecting said first and second holders, a socket attached to the top of the frame, said socket adapted to grip a nozzle of a caulk tube and form a seal, said socket and said second holder being spaced apart in opposition, said resilient biasing member biasing a caulk tube held in said carrier between the socket and said first holder.

2. The carrier of claim 1 wherein the frame is formed as a band having a width at least as wide as the diameter of a caulk tube to be held in the carrier.

3. The carrier of claim 1 wherein the frame has a face with male and female linking members for connecting two similar carriers together.

4. A carrier for holding at least one caulk tube of the type having a cylindrical hollow body for containing a viscous material, a piston slidably disposed within a bore of said hollow body and adapted to seal said viscous material within said body, a cavity formed between the piston and a first end of the body for receipt of a plunger of a caulking gun, a cap at a second end of said hollow body, and a tapered nozzle extending from said cap through which said viscous material is extruded when said piston is forced into said bore by the plunger, said carrier comprising:

a frame with a base, a top and first and second sides for interconnecting the base and the top, a first holder for attaching to a first end of a caulk tube, a second holder attached to the base of the frame, a spring interconnecting said first and second holders, a post on the top of the frame over which a length of flexible tubing is fitted, said tubing adapted to grip a nozzle of a caulk tube and form a seal, said post and said second holder being spaced apart in opposition, said spring and flexible tubing resiliently biasing a caulk tube held in said carrier between the post and said first holder.

5. The carrier of claim 4 wherein the first holder has a recess with an internal diameter for interference fit with a first end of the spring and wherein the second holder has an outside diameter for interference fit with a second end of the spring.

6. The carrier of claim 4 wherein a handhold is formed in the top of the frame.

7. The carrier of claim 4 wherein the frame is formed as a band having a width at least as wide as the diameter of a caulk tube to be held in the carrier.

8. A carrier for holding at least one caulk tube of the type having a cylindrical hollow body for containing a viscous material, a piston slidably disposed within a bore of said hollow body and adapted to seal said viscous material within said body, a cavity formed between the piston and a first end of the body for receipt of a plunger of a caulking gun, a cap at a second end of said hollow body, and a tapered nozzle extending from said cap through which said viscous material is extruded when said piston is forced into said bore by the plunger, said carrier comprising:

a frame with a base, a top and first and second sides for interconnecting the base and the top, a plug which is received in a cavity at a first end of a caulk tube, at least one boss on the base of the frame, a coil spring interconnecting the plug and the boss, at least one post on the top of the frame over which a length of flexible tubing is fitted, said tubing adapted to grip a nozzle of a caulk tube and form a seal, said post and said boss being spaced apart in opposition, said spring and flexible tubing resiliently biasing a caulk tube between the post and the plug.

9. The carrier of claim 8 wherein the plug is cylindrical with first and second sidewalls of stepped diameter interconnected by an annulus forming an abutment shoulder, said first sidewall having an outside diameter slightly less than the inside diameter of a bore of a caulk tube for interference fit and said second sidewall having an inside diameter for interference fit with an outside diameter of the coil spring at a first end of the coil spring and wherein said boss has an outside diameter slightly less than the inside diameter of the coil spring for an interference fit with the coil spring at a second end of the coil spring.

10. The carrier of claim 8 wherein a handhold is formed in the top of the frame.

11. The carrier of claim 8 wherein the frame is formed as a band having a width at least as wide as the diameter of a caulk tube to be held in the carrier.

12. The carrier of claim 8 wherein the frame has at least one face with male and female linking members for connecting two similar carriers together.

* * * * *